US005998748A

United States Patent [19]

Taylor

[11] Patent Number: 5,998,748

[45] Date of Patent: Dec. 7, 1999

[54] MANUALLY OPERATED ACTUATING DEVICE

[76] Inventor: David G. Taylor, 1510 Valwood Ave., Thomasville, Ga. 31792

[21] Appl. No.: 09/291,796

[22] Filed: Apr. 14, 1999

[51] Int. Cl.[6] ..... H01H 33/04

[52] U.S. Cl. ..... 200/331; 200/17 R; 218/12; 337/168

[58] Field of Search ..... 81/53.1; 200/17 R, 200/331; 218/1, 12; 294/19.1, 19.3, 24, 26; 337/156, 168, 171, 174–176, 194, 202, 203, 208, 211–214, 417; 439/476.1, 480, 477, 478, 483, 484

[56] References Cited

U.S. PATENT DOCUMENTS

| | | | |
|---|---|---|---|
| D. 350,447 | 9/1994 | Zinnbauer | D6/500 |
| 2,172,143 | 9/1939 | Lemmon | 200/116 |
| 3,962,770 | 6/1976 | Dooley et al. | 29/203 H |
| 4,433,220 | 2/1984 | Buhler et al. | 200/144 AP |
| 5,151,564 | 9/1992 | Rowe | 200/17 R |
| 5,191,311 | 3/1993 | Webb et al. | 337/168 |
| 5,266,759 | 11/1993 | Dohnal et al. | 200/144 B |
| 5,447,016 | 9/1995 | Baginski et al. | 200/43.11 |
| 5,534,673 | 7/1996 | Lehmann et al. | 218/68 |
| 5,534,858 | 7/1996 | Tinkham | 340/870.7 |
| 5,742,220 | 4/1998 | Scherer | 337/171 |
| 5,861,595 | 1/1999 | Wood et al. | 218/12 |

*Primary Examiner*—Michael Friedhofer
*Attorney, Agent, or Firm*—Brian D. Bellamy

[57] ABSTRACT

An actuating device operated by a hookstick is attached to an existing ring on a manually operated fused cutout switch or oil circuit recloser switch. The device comprises a cantilever and a clamp for attaching the cantilever about the existing ring. The cantilever a pair of lever arms, each having a hook-shaped receptacle for receiving a hookstick that is used to alternatively open or close the switch.

7 Claims, 4 Drawing Sheets

MANUALLY OPERATED ACTUATING DEVICE

INTRODUCTION

This invention relates to manually operated handles for recloser switches and lock outs on pole mounted circuit reclosers used by electric utilities. More particularly, this invention relates to a remotely operated actuating device for attaching to handles used to open and close a recloser or lockout switch using a hookstick, also known as a switchstick.

BACKGROUND OR THE INVENTION

Commercial and residential electrical power is distributed through electric cables which run along a series of power poles. Many of the poles are strategically mounted with automatic circuit reclosers, which are recognized by electric utilities as essential for achieving an important goal of providing continuity of electric service simply and economically. Some 80 to 95 percent of all system faults on overhead power distribution systems are temporary in nature and last from only a few cycles to a few seconds. These temporary faults are generally caused by wind, lightning, animals, tree branches, and switching surges. Reclosers sense and interrupt fault currents and automatically restore service after momentary outages by restoring current after the temporary fault condition is gone. If a fault is permanent, the recloser locks open after a preset number of operations and isolates the faulted section of the system from the main system.

Reclosers are mounted near the tops of utility poles and are provided with manually operated reclosing levers, also known as manual operating handles. The reclosing levers are used for manually opening and closing the recloser or setting the recloser to lockout after one operation. These manually operated levers are currently operated by a hand-held hookstick that is 30 to 40 feet in length. The hookstick is operated by utility worker either on a pole, in a bucket truck, or on the ground. The utility worker inserts the hookstick into a ring that extends from the end of the lever and is used to actuate the lever by pressing against the ring with the hookstick.

The prior art hookstick-operated levers are difficult and cumbersome to operate. Inserting the hookstick into the ring requires skill and patience. The difficulty of inserting the hookstick into the ring is further complicated by the conditions in which system faults generally occur. High winds and lightning are leading causes of system faults. Therefore, a need to operate a recloser lever often arises during poor weather and at nighttime. Placing the hookstick into a small ring at the top of a utility pole is even more arduous a task in wet, windy, and dark conditions which may cause numerous failed attempts and become time consuming. Time is of the essence in restoration of electrical power. Moreover, safety of utility personnel is a significant concern. Failed attempts to insert a hookstick into a ring increase the personnel's exposure to weather conditions or electrical hazards. The prior art fails to address these problems associated with the hookstick operated recloser lever.

SUMMARY OF THE INVENTION

Accordingly, the present invention solves the deficiencies found in prior art recloser levers operated by a hookstick and a ring-actuated lever. In particular, it is an object of the present invention to provide an effective means for adapting current recloser levers for easier and faster operation with a hookstick. The present invention prevents the expense of redesigning and replacing the prior art to solve the problems associated with hookstick operation. The present invention accomplishes this goal by eliminating the need to exercise skill and patience in placing a hookstick into a ring actuator.

In accordance with the present invention, and disclosed herein, is an improved device for providing operational control of a recloser lever by a hookstick. The device consists of a cantilever assembly that is adapted to attach to the existing ring of the recloser lever. Once the actuator device of the present invention is attached to the existing ring, the lever may be actuated without finding and placing the hookstick into the ring. Instead, the improved actuator device will allow a user to engage the hookstick by feeling the cantilever assembly with the hookstick and then moving the hookstick in the desired direction to open or close the recloser or adjust the lockout setting. Thus, the recloser lever may be actuated in a single attempt with less precision than needed for inserting hookstick into a prior art ring.

DETAILED DESCRIPTION

Figure 1:
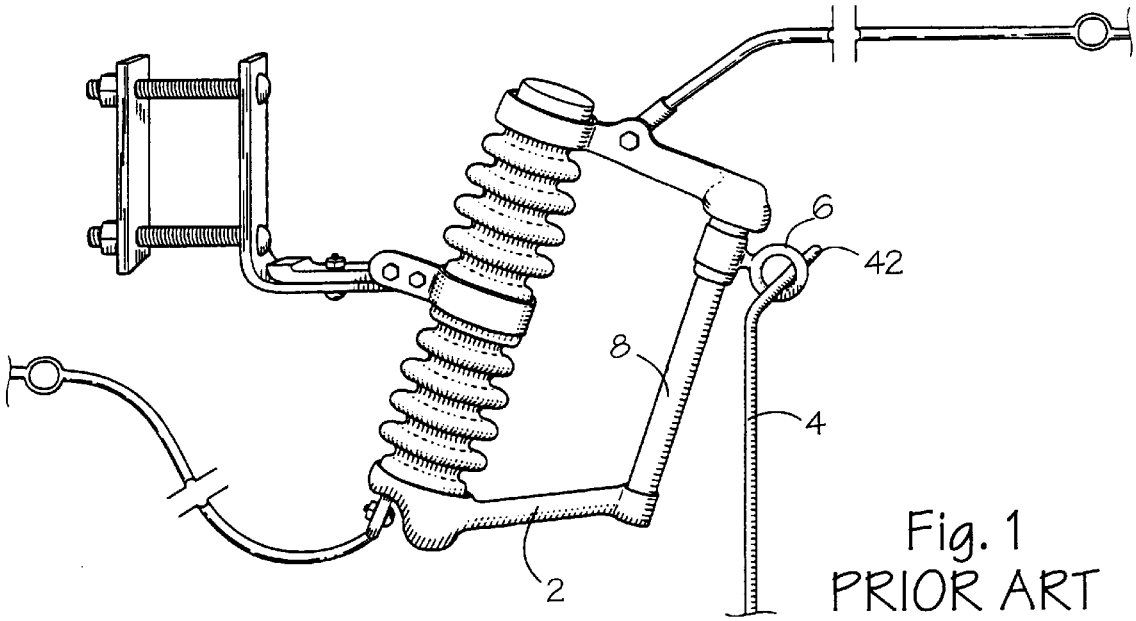
Fig. 1 PRIOR ART
FIG. 1 is a side view of the prior art cutout and arrester combination having a handle and ring manual operating switch.
Figure 8:
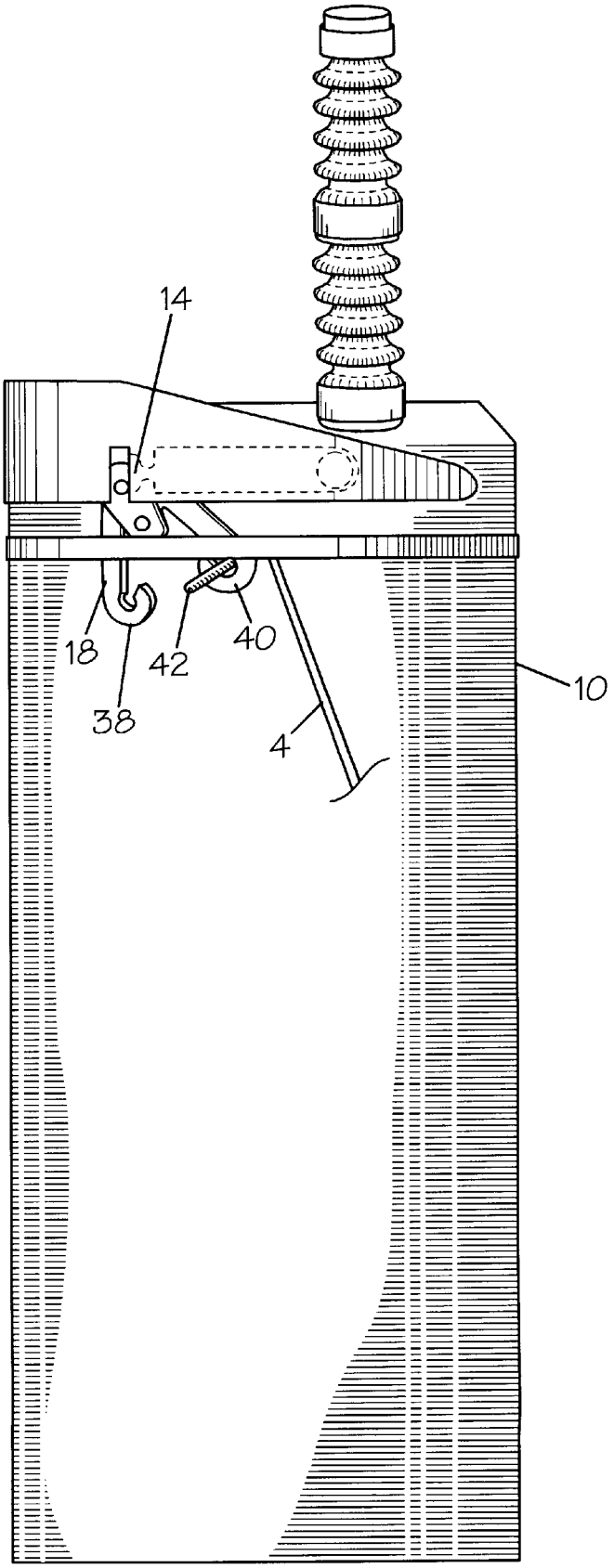
FIG. 8 is side view of the present invention shown attached to a single phase oil circuit recloser.

Referring to the drawings, FIG. 1 illustrates a cutout and arrester combination, also know as a lockout switch or fused cutout switch 2. As shown in FIG. 1, the fused cutout switch is generally operated by manually placing a hookstick 4 in a ring 6 and moving the ring to operate a handle 8 that is used to open or close the cutout switch. An equivalent method is used in the prior art in conjunction with oil circuit reclosers for manually operating a recloser switch. FIG. 8 depicts an oil circuit recloser 10, but with the present actuating device 12 attached thereto.

Figure 2:
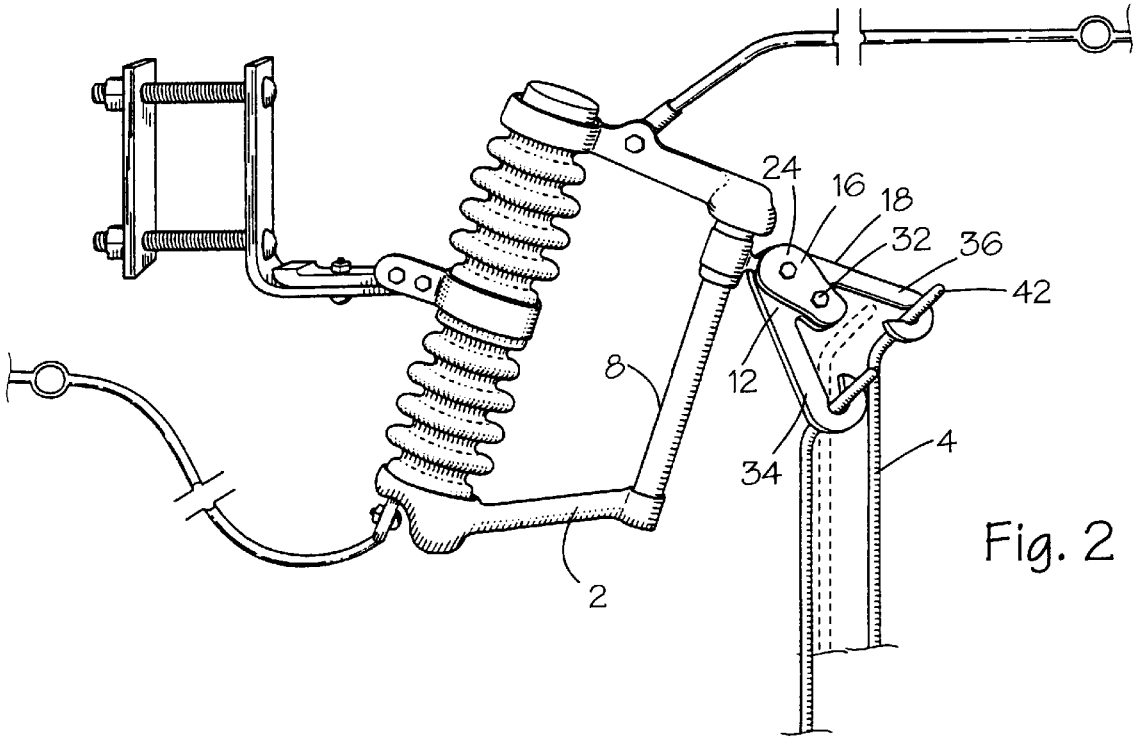
FIG. 2 is a side view of the present invention shown attached to a recloser cutout and arrester combination.

FIG. 2 illustrates the actuating device 12 of the present invention as used on the cutout switch 2. The actuating device, also known as a quick trigger, is attached to the existing ring 6. The same hookstick 4 as used in the prior art is used to open and close the cutout switch by engaging the actuating device in alternate positions on the actuating device as shown in the figure. The ring is caused by the actuating device to move the handle 8 in the same manner as before to actuate the switch, however the switch in more conveniently accessed and operated using the present actuating device. As shown in FIG. 8, the present actuating device also may be used on an oil circuit recloser switch 14 having the same type of ring for engaging the hookstick. The actuating device is used on the oil circuit recloser switch in the same manner as described previously.

Figure 3:
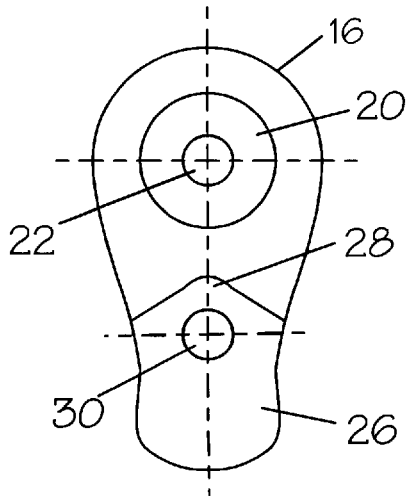
FIG. 3 is a front view of the ring clamp of the present invention.
Figure 4:
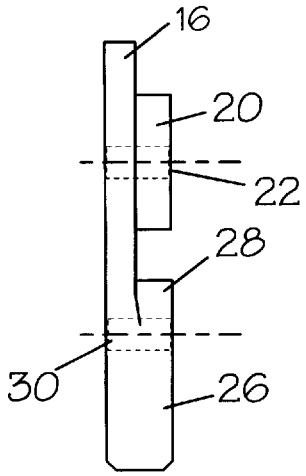
FIG. 4 is a side view of the ring clamp of the present invention.

The present invention comprises two primary parts that are bolted together on the ring 6 of a cutout switch 2 or recloser switch 14. The first part consists of a ring clamp 16 having a height of about 3 3/16 inches, and the second part consists of cantilever 18 having a height of about 6 3/8 inches. The ring clamp is shown in detail in FIG. 3 and FIG. 4.

The ring clamp 16 is about ¼ inch thick and has two raised members that increase the thickness of the clamp in those members another ¼ inch to about ½ inch. The first raised member 20 has a circular diameter and fits within the ring 6 such that the ¼ inch raised circular diameter is within the inner diameter of the ring. A first aperture 22 is provided in the first raised member for receiving a bolt 24. The second raised member 26 has a point 28 at the tip of an A-shaped shoulder that bears against the outer diameter of the ring when the clamp is attached to the cantilever 18. A second aperture 30 is provided in the second raised member for receiving a bolt 32.

Figure 5:
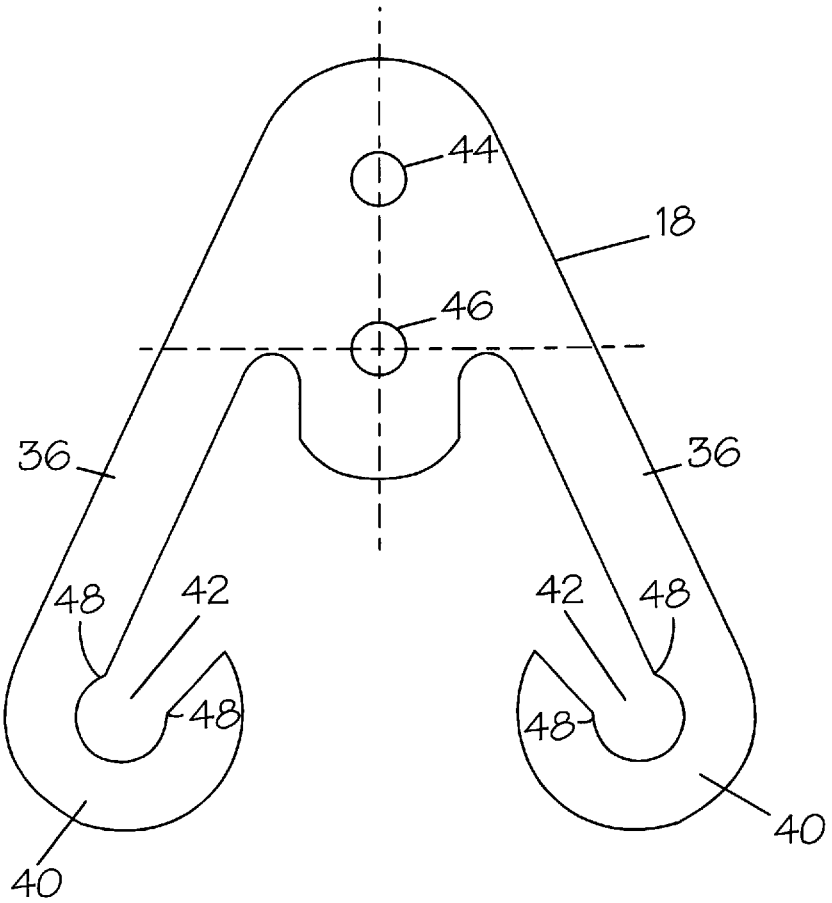
FIG. 5 is a front view of the cantilever of the present invention.
Figure 6:
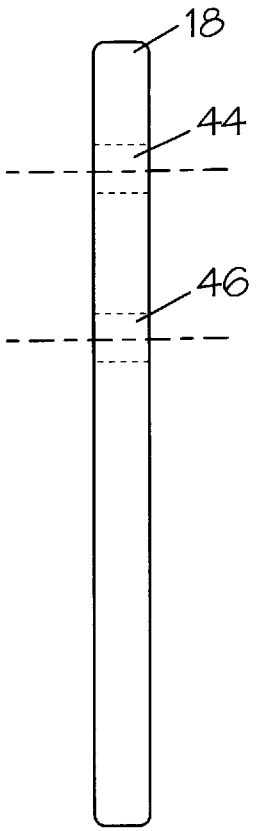
FIG. 6 is a side view of the cantilever of the present invention.

The second part or cantilever 18 is shown in FIGS. 5 and 6. The cantilever part is A-shaped and includes a first lever arm 34 and a second lever arm 36 that oppose each other at an angle. In the embodiment shown, the lever arms are at an acute angle of about 25 degrees to 35 degrees with respect to each other. Each lever arm terminates in a curved hook-shaped receptacle 38 and 40 for receiving a limb 42 at the top of a hookstick 4 like that commonly used to actuate recloser switches. The hook-shaped receptacles each include a receiving slot sized such that the hookstick limb fits into the receptacle. Slight lips 48 may be provided on the receptacles on each side of the receiving slots to hinder the hookstick limb from slipping out of the receptacle while the actuating device 12 is operated.

Figure 7:
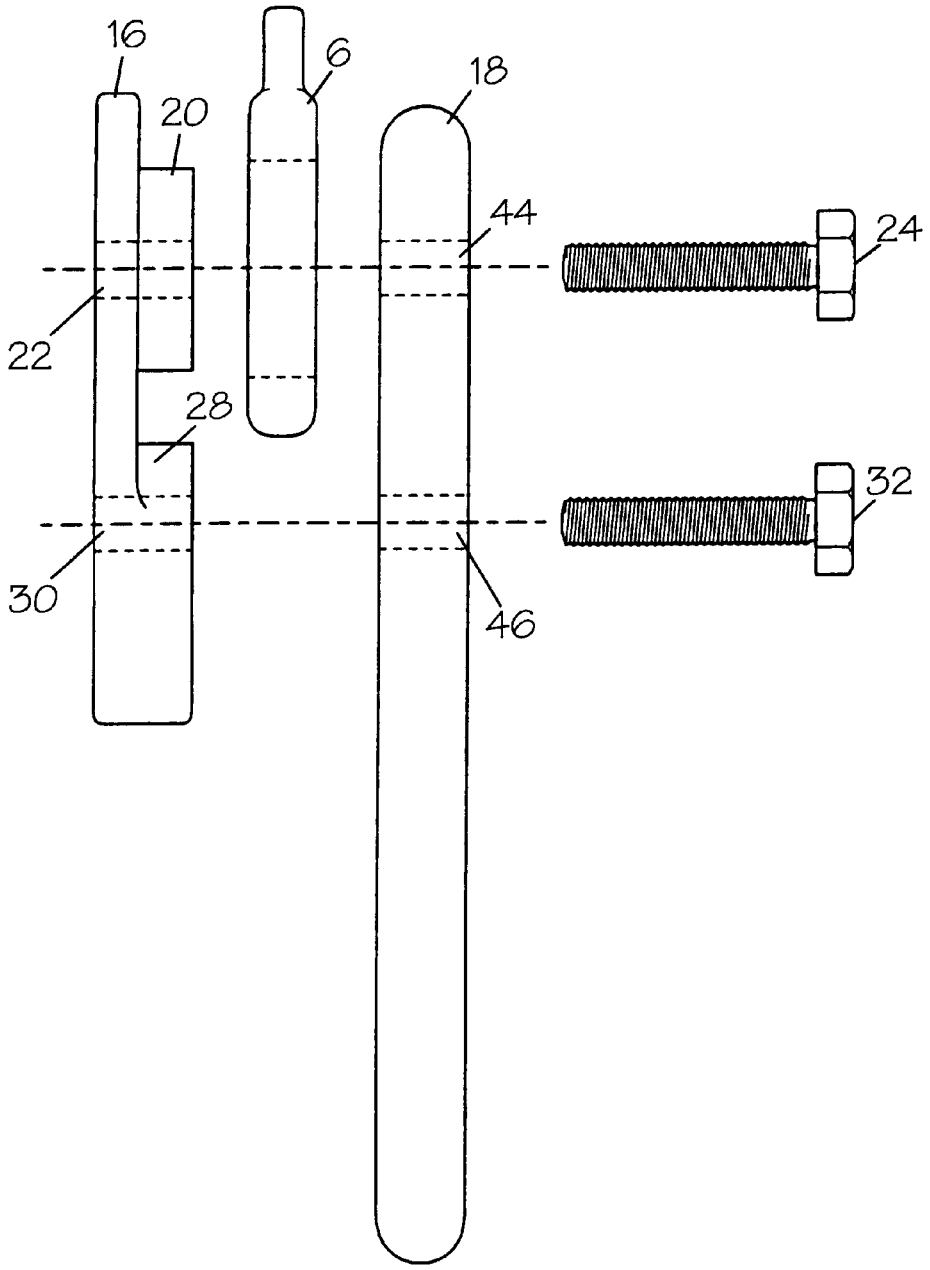
FIG. 7 is an exploded side view of the present invention in relation to the prior art ring.

Apertures 44 and 46 are provided in the cantilever 18. These apertures in the cantilever align with the apertures 22 and 30 on the ring clamp 16. The bolts 24 and 32 are inserted through the apertures of both the cantilever and ring clamp for joining the parts together about a ring 6 as shown in FIG. 7. In lieu of a pair of bolts, a u-bolt or other retaining means could be used for securely attaching the parts to the ring. After the device is attached to the ring, the limb 42 of a standard hookstick 4 is inserted into the receiving slots of the cantilever and the limb is pressed against one of the hook-shaped receptacles 38 or 40 to move the cantilever. As the cantilever is moved, the straight edges of the second raised member 26 of the ring clamp bear against the ring and the cantilever operates the ring 6 and handle 8 to open and close the recloser switch 14 or cutout switch 2.

While a preferred form of the actuating device 12 of the present invention has been shown in the drawings and described, variations in the invention's embodiment and practice will be readily apparent to those persons skilled in the art. Therefore, the invention should not be construed as limited to the specific form shown and described, but instead is as set forth in the following claims.

I claim:

1. An actuating device for attachment to an existing ring on a manually operated switch comprising:

a cantilever;

a means for attaching said cantilever about said ring;

said cantilever including a means for receiving a hookstick;

whereby said hookstick moves said actuating device to alternatively open or close said switch.

2. The device of claim 1 wherein said actuating device is attached to an oil circuit recloser switch.

3. The device of claim 1 wherein said actuating device is attached to a fused cutout switch.

4. The device of claim 1 wherein said cantilever includes a first lever arm having a terminal end and a second lever arm having a terminal end, said first lever arm and second lever arm being angularly disposed with respect to each other.

5. The device of claim 4 wherein said first lever arm is disposed at a 25 degree to 35 degree angle with respect to the second lever arm.

6. The device of claim 4 wherein said means for receiving a hookstick includes a hook-shaped receptacle at the terminal end of said first lever arm and a hook-shaped receptacle at the terminal end of said second lever arm.

7. The device of claim 1 wherein said means for attaching said cantilever about said ring includes a clamp having a first raised member and a second raised member, said first raised member disposed within said ring, and a means for attaching said first raised member and said second raised member of said clamp to said cantilever.

* * * * *